US008578837B1

(12) United States Patent
Burhoe

(10) Patent No.: US 8,578,837 B1
(45) Date of Patent: Nov. 12, 2013

(54) PRESSURE UNLOADING VALVE TO CUSHION A PNEUMATIC CYLINDER

(76) Inventor: John C. A. Burhoe, Fairlawn, OH (US)

( * ) Notice: Subject to any disclaimer, the term of this patent is extended or adjusted under 35 U.S.C. 154(b) by 854 days.

(21) Appl. No.: 12/800,304

(22) Filed: May 12, 2010

(51) Int. Cl.
*F15B 15/22* (2006.01)
*F15B 13/04* (2006.01)

(52) U.S. Cl.
USPC ..... 91/405; 91/461

(58) Field of Classification Search
USPC ..... 91/394, 395, 404, 405, 406, 407, 461; 92/85 R, 85 B
See application file for complete search history.

(56) References Cited

U.S. PATENT DOCUMENTS

| | | | | |
|---|---|---|---|---|
| 1,604,548 | A | 10/1926 | Dapron | |
| 2,755,775 | A | 7/1956 | Flick | |
| 3,805,672 | A | 4/1974 | Pekrul | |
| 3,933,080 | A | 1/1976 | Corrie | |
| 4,210,064 | A * | 7/1980 | Beerens | 91/394 |
| 4,523,511 | A | 6/1985 | Dixon | |
| 4,700,611 | A | 10/1987 | Kaneko | |
| 5,423,243 | A | 6/1995 | Yamashita et al. | |
| 5,517,898 | A | 5/1996 | Kim et al. | |
| 5,623,861 | A | 4/1997 | Ward et al. | |
| 6,178,868 | B1 | 1/2001 | Gagnon et al. | |
| 6,536,327 | B2 | 3/2003 | Zona | |
| 6,758,127 | B2 | 7/2004 | Schult | |
| 7,387,061 | B2 * | 6/2008 | Kobata et al. | 91/405 |
| 7,395,749 | B2 | 7/2008 | Adams | |

FOREIGN PATENT DOCUMENTS

| | | |
|---|---|---|
| JP | 2613150 | 5/1997 |
| JP | 2002130213 | 5/2002 |
| JP | 2003254303 | 10/2003 |
| JP | 2006046500 | 2/2006 |

OTHER PUBLICATIONS

Parker Design Engineer's Handbook, Bulletin 0224-B1, 1973, ISBN1-55769-018-9, p. g-13, Cleveland, Ohio.

* cited by examiner

*Primary Examiner* — Michael Leslie

(57) ABSTRACT

The pressure in the downstream side of a pneumatic cylinder's piston (1*g*) is allowed to exhaust. At a certain point, the downstream exhaust is blocked, causing the pressure to rise against the downstream side of the piston. A valve (5) opens when the downstream chamber has reached its maximum pressure. The output of valve (5) opens a second valve (3). Valve (3) rapidly exhausts the remaining air on the downstream side of the piston (1*p*). With no air on the downstream side of piston (1*p*), piston (1*p*) stops and does not bounce back. Changing the volume of inactive regions (1*m*) or (1*n*) sets the stopping point to coincide with the end of stroke of piston (1*p*). A check valve (4) and orifice (6*a*) allow the air in the pilot port in valve (3) to slowly bleed out, resetting valve (3) for the next cycle.

11 Claims, 8 Drawing Sheets

SECTION 100-100

SECTION 101-101

SECTION 102-102

PRESSURE UNLOADING VALVE TO CUSHION A PNEUMATIC CYLINDER

INTRODUCTION

Fluid powered, expandable chamber motors are used to apply a force along a straight line. These motors are usually known as either pneumatic or hydraulic cylinders. Pneumatic cylinders are powered by compressible fluids. Hydraulic cylinders are powered by incompressible fluids. Fluid powered cylinders are simple to make, easy to use, and relatively low in cost. Furthermore, pneumatic cylinders are safe in fire and explosive environments.

The characteristics of the fluid affect the dynamics of these cylinders. For example, the compressibility of air makes it hard to control a pneumatic cylinder's deceleration. The easiest solution is to apply no controls, and simply let the piston to run into the end of the cylinder. For many applications, where the speed of travel is relatively slow, this method of control may be acceptable. Unfortunately, many applications require higher speeds. The resulting high-speed impact between the piston, and the cylinder end, causes undo stresses.

DESCRIPTION OF PRIOR ART

Since the beginning of the $20^{th}$ Century, many inventors have proposed many devices to cushion a cylinder's piston. The United States alone has issued well over 50 patents. There are too many previous patents to include all of them here. Nevertheless, a few previous patents shall be included.

U.S. Pat. No. 1,604,548 shows a pneumatic cylinder used to open a door. This early device used mechanical springs for shock absorption.

U.S. Pat. No. 2,755,775 allowed for the air pressure in the deceleration end to build up. A flexible cushion sleeve decreases in diameter when more air pressure is applied to it. The decreased diameter increases the clearance between the sleeve and the cylinder. More air can escape. Air pressure is released, minimizing bounce-back.

U.S. Pat. No. 3,805,672 has a raised boss on the piston. As the piston moves along the stroke, the air at the low pressure end of the cylinder exits through a bore at the end of the cylinder. Near the end of the stroke, a raised piston boss enters a bore in the end of the cylinder. This prevents air from exiting through the bore. A second passage allows air to continue to escape through a needle valve. The needle valve determines how quickly air can exit. The needle valve can be adjusted to adjust the cushioning rate. When the needle valve is fully open, the exhausting air flows freely. This give minimal, or no, cushion. A fully closed needle valve traps the remaining air. The trapped air can then keep the piston from getting to the end of stroke.

U.S. Pat. No. 3,933,080 uses two chambers. The first chamber is the same chamber as mentioned in U.S. Pat. No. 3,805,672. The second chamber is a chamber formed by the end of the boss and the bottom of the bore. According to this patent, the air on the low pressure side of the piston does not exit through the bore, but rather through a second hole. As the piston nears the end of the stroke, the piston boss again enters the cylinder end bore. Pressure builds in the second chamber. Building pressure in chamber 2, decreases the size of the main exhaust path. This slows the speed of the air exiting from the first chamber.

Through a complex set of valves, and cross-bars, U.S. Pat. No. 4,523,511 gradually closes the exhaust valves of a cylinder as its piston approaches the end of stroke.

In U.S. Pat. No. 4,700,611 adds special cushioning chambers to each end of the cylinder. Compressed air fills these cushioning chambers. Near the end of stroke, the main piston impacts a mechanical cushioning pad. A mechanical cushioning pad pushes into the special cushioning chamber. This increases the air pressure in the cushioning chamber. It also opens valves in the special cushioning pad to allow air to escape. The combined affect cushions the piston.

U.S. Pat. No. 5,423,243 adds a boss to the piston. At the cylinder end is a bore. For most of the piston stroke, the air exhausts through the bore. When the boss enters the bore, the remaining air becomes trapped. The air then goes through a secondary passage to one chamber of a spring adjusted relief valve. A tertiary passage connects the bore with a second chamber in the relief valve. The pressure difference between the first and second chambers opens the relief valve. Trapped air now exits through the relief valve. The amount of opening determines the exhaust flow rate, and the deceleration of the piston.

U.S. Pat. No. 5,517,898 uses a two-fold method to cushion the cylinder. The first step uses a set of sleeves to gradually restrict the exhausting air flow, as the cylinder approaches the end of travel. The second step has the cylinder piston depress a plunger to rapidly exhaust any remaining air in the cylinder chamber, near the end of stroke. The rapid exhaust is based on piston position.

U.S. Pat. No. 5,623,861 uses a special venting sleeve, with two pistons, three separate chambers, and two slowing orifices, to control the speed, and impact force of the piston.

U.S. Pat. No. 6,178,868 uses an external set of components that include accumulators to pressurize the exhaust air. The pressurized exhaust air provides a deceleration force to the piston. The exhausting air is directed to the accumulators based on electrical signals sent from position sensors, or from computers. The accumulators can be sized differently to allow for some adjustability in the rate of deceleration.

U.S. Pat. No. 6,536,327 uses a two part cushion system. The first part of this invention purposefully traps some air in the end of cylinder, in a special case version of U.S. Pat. No. 3,805,672. The second part of the cushion adds rubber pads to further absorb the impact forces.

U.S. Pat. No. 6,758,127 uses a variation of U.S. Pat. No. 3,805,672. Cushioning air from either end is forced to flow to a single throttling valve. This arrangement permits a more compact cylinder.

U.S. Pat. No. 7,395,749 uses a hollow piston rod to handle two tasks. First, a hollow rod is lighter than a solid rod, allowing for faster acceleration. For the second task, the hollow rod performs holds a secondary piston. The secondary piston acts to shut off exhaust air from escaping during the retract direction. The shut off piston traps air between the piston and the cylinder end. The trapped air cushions the piston as it reaches its end of travel.

Japanese Patent JP2002130213 first uses a relief valve to directly release pressure from the downstream side of the piston. In the later stages of cushioning, after the relief valve closes due to insufficient pressure, the air from the downstream side of the piston exhausts through a throttle groove.

In Japanese patent JP2003254303, a succession of holes open as the piston nears its end of stroke. This succession of holes provides for a multi-step means to slow the piston.

Japanese Patent JP2006046500 uses an add-on device to cushion a pneumatic cylinder. The slowdown rate of the cylinder is adjusted by changing the flow in a throttle (needle) valve. The stroke of the cylinder is adjusted by varying the length of a stroke adjustment bolt.

Japanese Patent JP2613150 uses an external pneumatic shock absorber to slow and stop a separate pneumatic cylinder. A pressure reducer takes the supply line air, and regulates the pressure to the pneumatic shock absorber, in order to provide a constant stopping force.

The prior art suggest various pneumatic circuits. The Parker Design Engineer's Handbook, Bulletin 0224-B1, provides an example of an air cushion composed of components external to cylinder. These external components allow the cylinder air to exhaust freely, until pressure builds in the pilot port of the exhaust valve. When the pilot pressure builds, the exhaust air then goes through a variable orifice. Slowing the velocity of the exhausting air, slows down the piston.

SUMMARY

When air is supplied to a pneumatic cylinder, the cylinder's piston moves along its stroke. As the piston approaches the end of its stroke, the air exhaust passage is blocked. Blocking the exhaust passage traps some air on the downstream side of the piston. The continued movement of the piston compresses this downstream air. The compressed air trapped in the downstream side of the piston brings the piston to a stop. Furthermore, the air pressure on the downstream side of the piston becomes greater than the air pressure on the upstream side of the piston. This inverted pressure difference reverses the piston's direction of travel, or makes the piston 'bounce back'. Opening a valve in the downstream chamber, just before the piston stops, allows air pressure in the downstream chamber to rapidly decrease. The piston stops with no more downstream pressure to make it bounce back. Changing the inactive volume moves the piston's stopping point to coincide with the end of the stroke.

DRAWINGS

Figures

REFERENCE NUMERALS

| | |
|---|---|
| 1 | pneumatic cylinder |
| 1a | cap end chamber |
| 1b | head end chamber |
| 1c | cylinder rod |
| 1d | head bore passage |
| 1e | cap bore passage |
| 1f | head end piston assembly boss |
| 1g | piston flange |
| 1h | cap end piston assembly boss |
| 1j | cap port passage |
| 1k | head port passage |
| 1m | head end inactive region |
| 1n | cap end inactive region |
| 1p | piston |
| 1q | spacer pocket |
| 1r | space pocket |
| 1s | spacer pocket |
| 1t | spacer pocket |
| 1u | cushion pocket |
| 1v | cushion pocket |
| 1w | end cap |
| 1y | main tube |
| 1z | head cap |
| 2 | cushioning cartridge |
| 2' | second article of cushioning cartridge |
| 2a | pressure feed passage |
| 2b | pilot passage |
| 2c | check valve exhaust passage |
| 2d | valve inlet passage |
| 2e | interconnect passage to spool |
| 2f | spool inlet cavity |
| 2g | spool outlet cavity |
| 2h | interconnect passage from spool |
| 2j | cushion exit passage |
| 2k | tool insert passage |
| 2m | o-ring groove |
| 3 | main exhaust valve |
| 4 | check valve |
| 5 | pressure relief valve |
| 6 | restricting orifice plug |
| 6a | orifice |
| 7 | bolt |
| 8 | inactive volume spacer |
| 11 | exit manifold |
| 21 | pressure end cap |
| 22 | main housing |
| 23 | exhaust end cap |
| 31 | spool |
| 31a | spool upstream hole set |
| 31b | spool downstream hole set |
| 31c | spool partition |
| 31d | spool chamber |
| 31e | outer wall |
| 31f | spool open end |
| 31g | spool closed end |
| 32 | spool spring |
| 33 | o-ring |
| 41 | check valve ball |
| 42 | check valve spring |
| 51 | pressure relief stem |
| 52 | pressure relief spring |
| 53 | pressure relief washer |
| 54 | pressure relief pressure adjuster |

DETAILED DESCRIPTION

Figure 1:
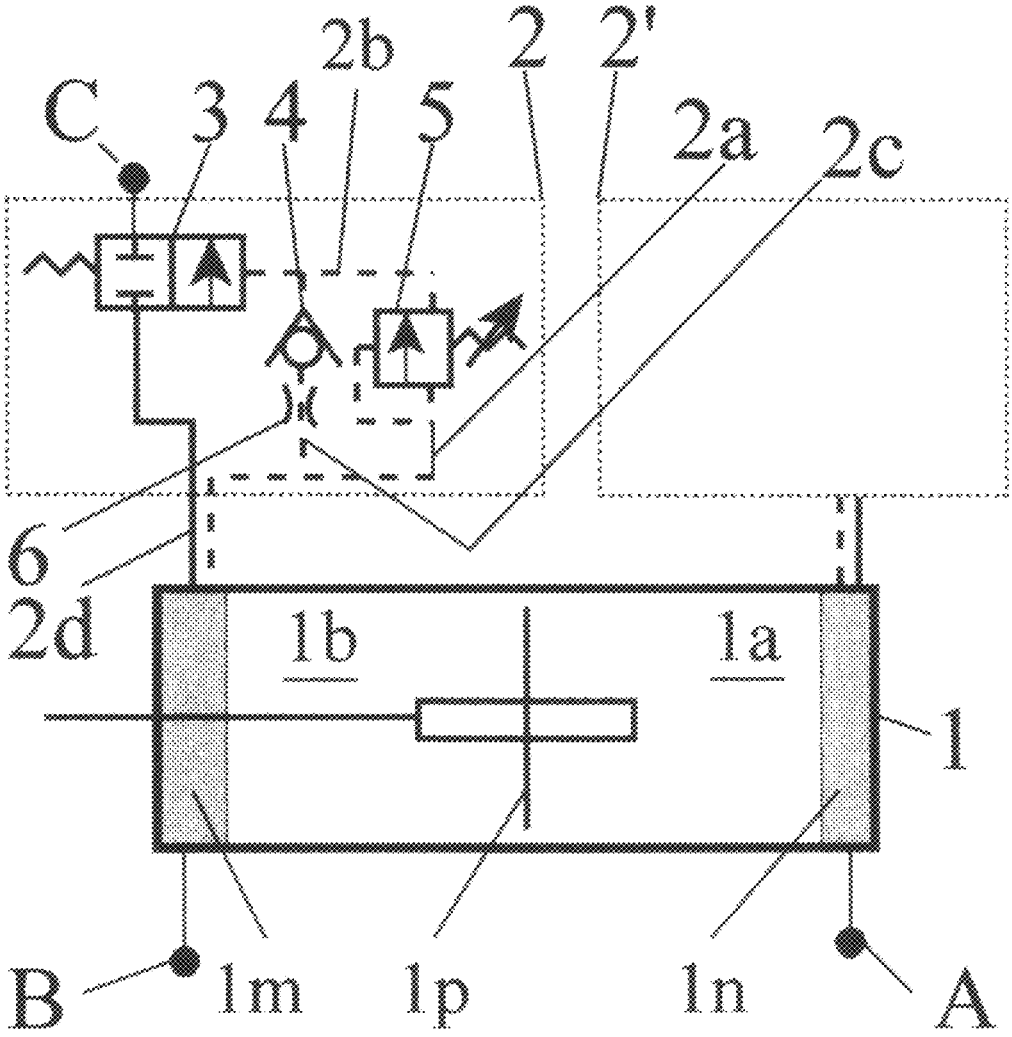
FIG. 1 is a high level logic schematic of the cushioning cartridge, with a typical single rod, double acting, pneumatic cylinder.
Figure 2:
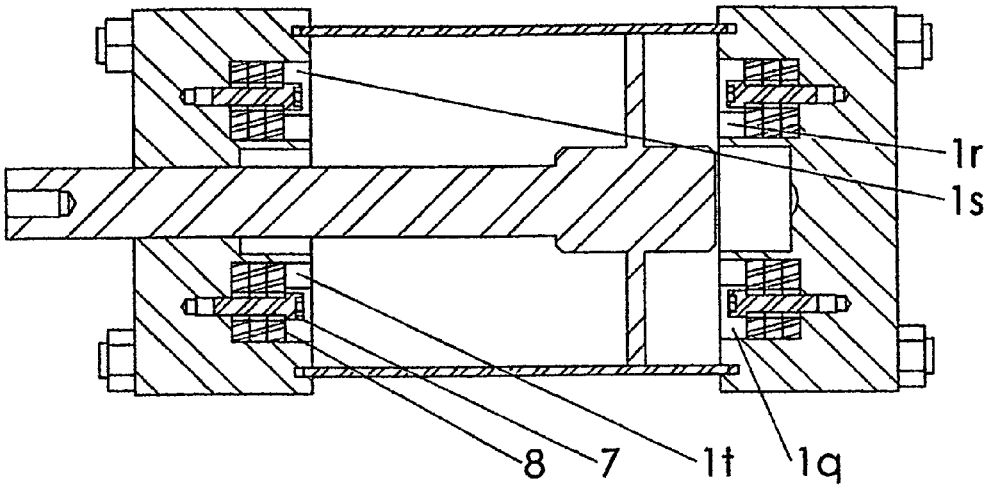
FIG. 2 is a cross-sectional view of the pneumatic cylinder showing the inactive volume spacers.
Figure 3:
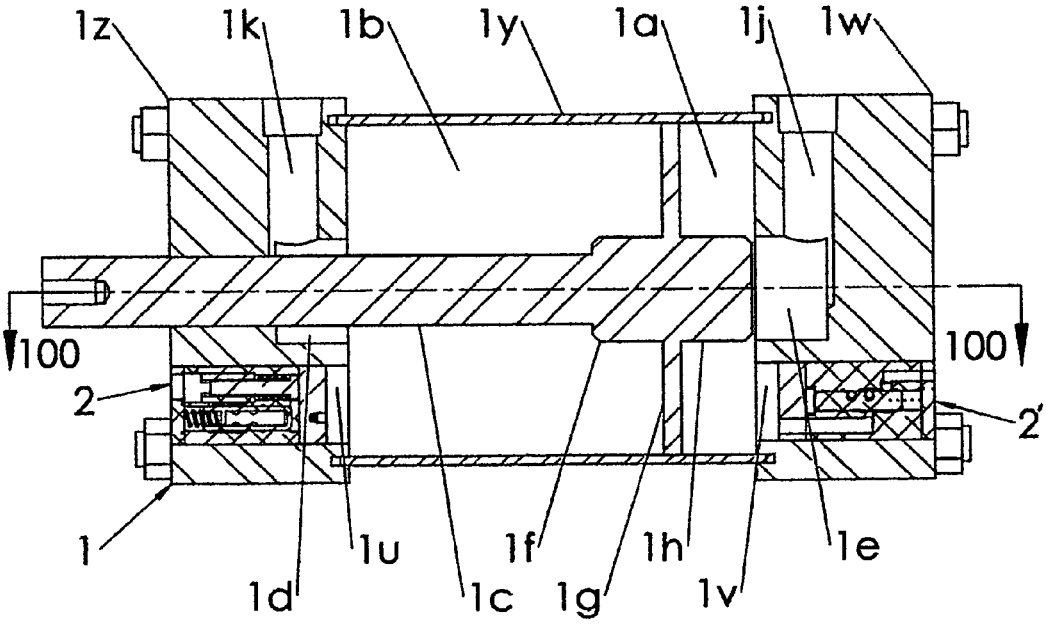
FIG. 3 is a cross-sectional view of the pneumatic cylinder with the cushioning cartridge

Referring to FIG. 1, FIG. 2 and FIG. 3, the body of a typical, single rod, double acting, pneumatic cylinder 1 consists of three main components: the head cap 1*z*, the main tube 1*y*, and the end cap 1*w*. Inside the cylinder is an internal moving element. The internal moving element is usually known as a piston 1*p*. Piston 1*p* consists of a piston flange 1*g*, a piston rod 1*c*, two bosses 1*f*, 1*h*, and miscellaneous fasteners and seals, which are not shown. Rod 1*c* goes through a hole, not shown, in cap 1*z*. A head end chamber 1*b* is the internal section of cylinder 1 between flange 1*g* and cap 1*z*. Chamber 1*b* communicates with port B via head bore passage 1*d*, and head port passage 1*k*. Cap end chamber 1*a* is the internal section of cylinder 1 between flange 1*g* and cap 1*w*. Chamber 1*a* communicates with port A via cap bore passage 1*e*, and cap port passage 1*j*.

Piston 1*p* is free to travel inside cylinder 1, from one end to the other end. The distance that piston 1*p* can travel is known as the stroke. When piston 1*p* is located at the head end of cylinder 1, an inactive region 1*m* forms between flange 1*g* and cap 1*z*. Region 1*m* is called inactive, because it never completely empties of air. In this embodiment, region 1*m* consists of spacer pockets 1*s*, 1*t*, cushion valve pocket 1*u*, and any gaps, not shown, that exist between cap 1*z*, and flange 1*g*. Pockets 1*s*, 1*t*, and 1*v* are recessed into cap 1*z*. A similar inactive region 1*n* forms between flange 1*g*, and cap 1*w*, when piston 1*p* is located at the cap end of cylinder 1. Region 1*n* consists of spacer pockets 1*r*, 1*q*, cushion valve pocket 1*v*, and any gaps that exist between flange 1*g*, and cap 1*w*. Pockets 1*q*, 1*r*, and 1*v* are recessed into cap 1*w*.

Figure 9:
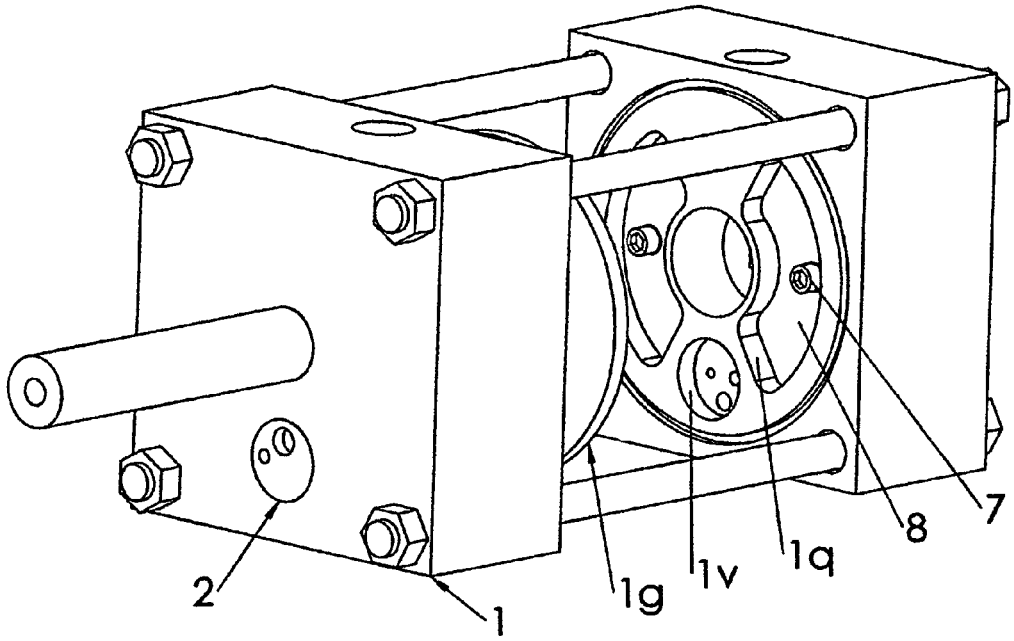
FIG. 9 is a 3D view of the cylinder, with the main cylinder tube removed for clarity, showing the inactive volume spacers.

There are two identical cushioning cartridges, 2, and 2', which thread into pockets 1*u* and 1*v*, respectively, as shown in FIG. 3. The threads are not shown in the drawings. Per FIG. 9, when cartridge 2 or 2' is installed into cylinder 1, cap 23 faces outward from cylinder 1, and cap 21 faces into the inside of cylinder 1.

Figure 4:
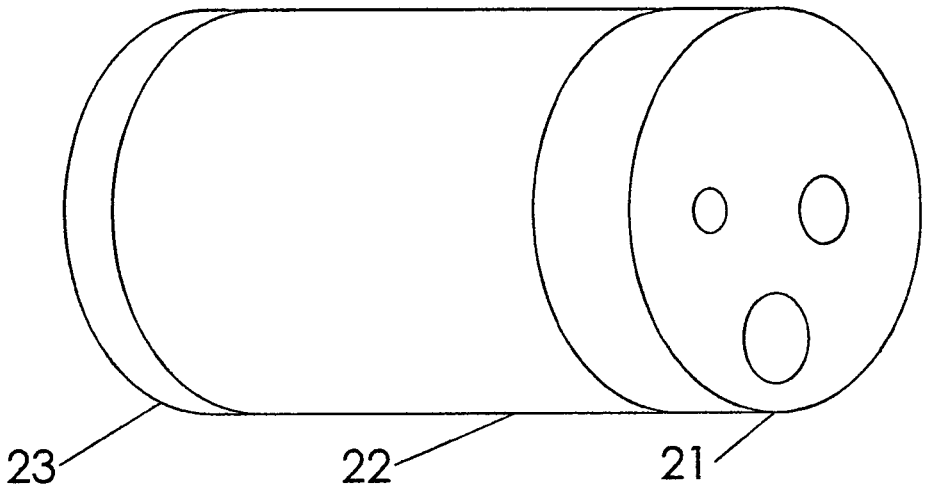
FIG. 4 is a 3D view of the sides and the pressure end of the cushioning cartridge.
Figure 5:
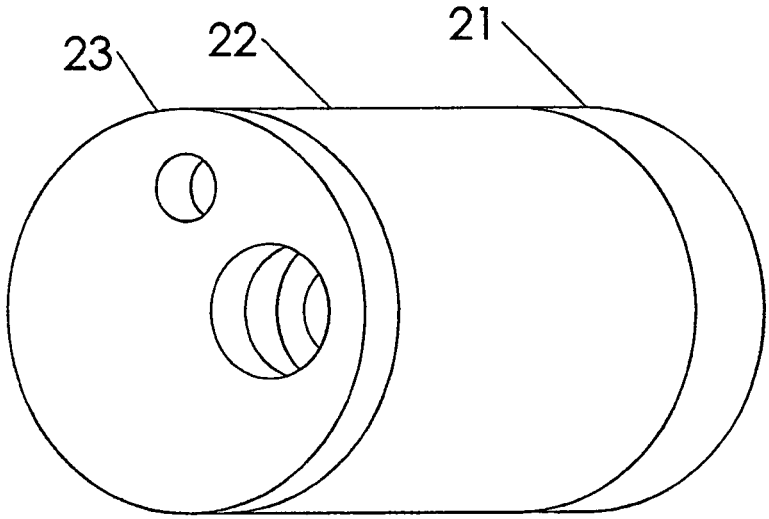
FIG. 5 is a 3D view of the sides and the exhaust end of the cushioning cartridge
Figure 6:
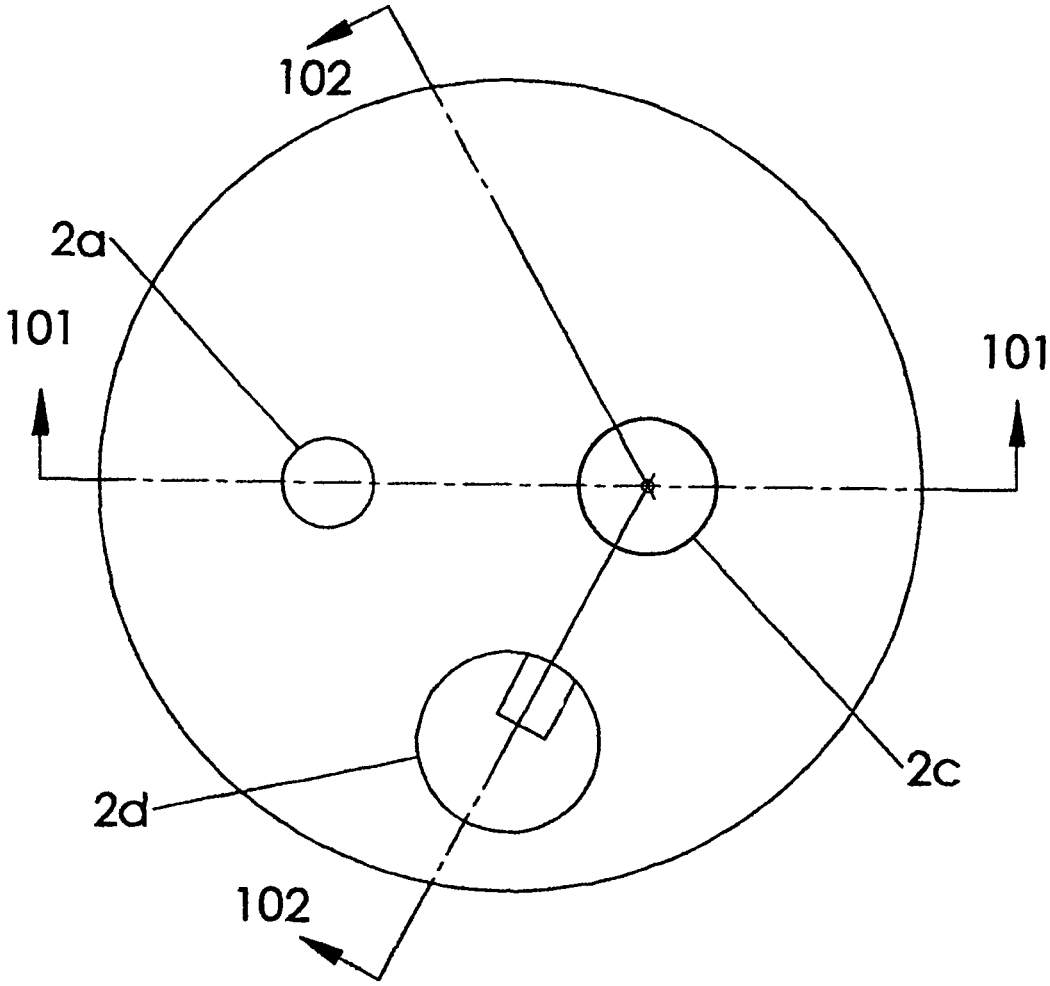
FIG. 6 is an end view of the pressure end of the cushioning cartridge. This view is used to define the cross-sectional views of FIG. 7 and FIG. 8.

Referring to FIG. 4, this embodiment shows that cartridge 2 is cylindrical. Cartridge 2 consists of three parts: a pressure end cap 21, an outlet end cap 23, and a main housing 22. The fasteners holding cap 21, cap 23, and housing 22 together are not shown. Per FIG. 6, cap 21 has three holes, or passages, which run through it, labeled 2*a*, 2*c*, and 2*d*. The pressure feed passage 2*a* is offset from the center axis of the cushioning cartridge. The check valve exhaust passage 2*c* is on the other side of the main center axis from the pressure feed hole 2*a*. The valve inlet passage 2*d*, lies between passage 2*a* and passage 2*c*, and is offset to the side of passage 2*a* and passage 2*c*.

Figure 7:
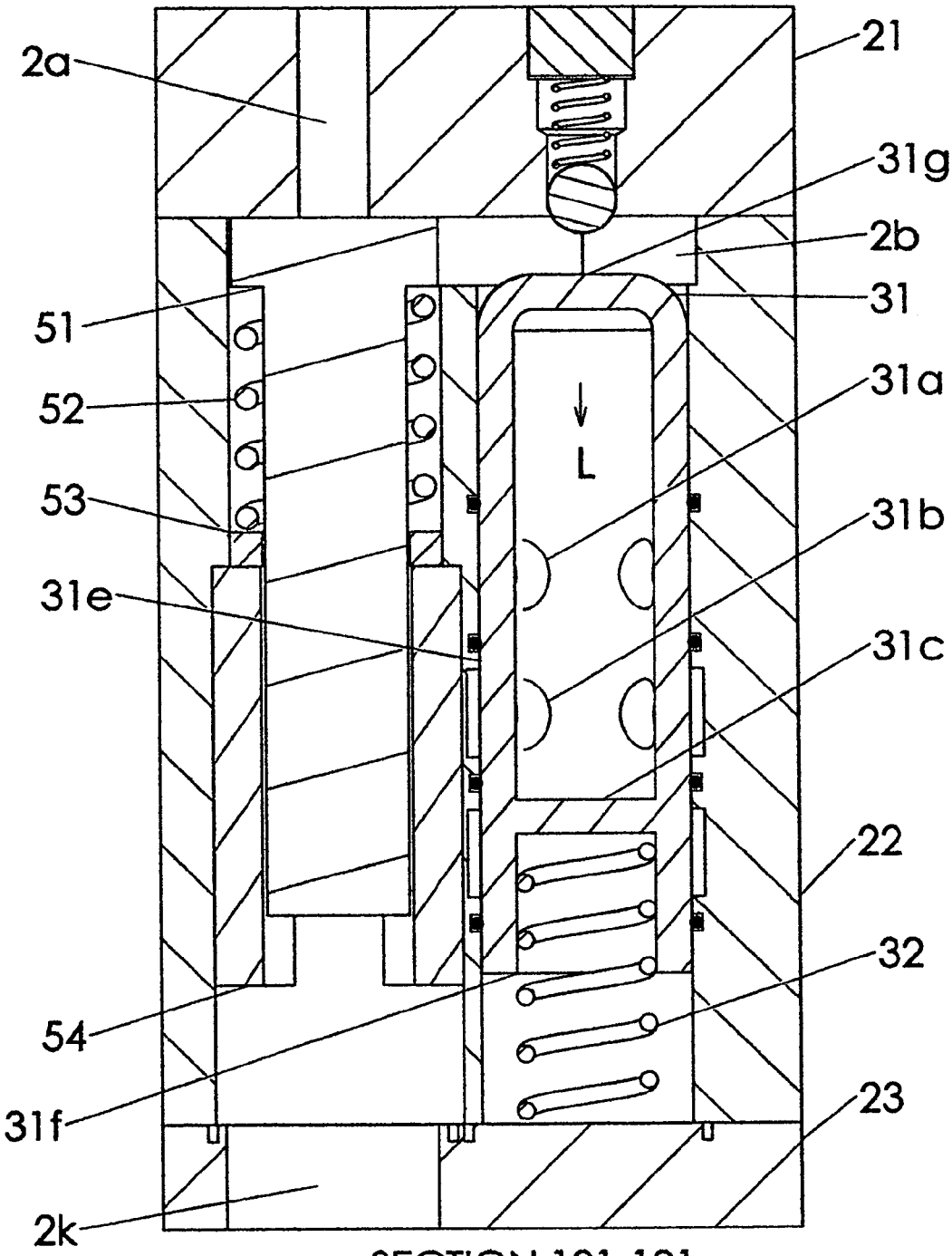
FIG. 7 is a cross-sectional view of the cushioning cartridge showing the pressure relief valve.

Referring to FIG. 1 and FIG. 7, passage 2*a* runs from the outside end of cap 21 to a pressure relief valve 5. In this embodiment, valve 5 consists of several parts: a pressure relief stem 51, a pressure relief spring 52, a pressure relief washer 53, and a pressure relief pressure adjuster 54. Stem 51 is coaxial with passage 2*a*. Spring 52 forces stem 51 against cap 21. The other end of spring 52 rests against washer 53. Washer 53 in turn rests against adjuster 54. Adjuster 54 is threaded into housing 22. The threads are not shown. A tool, not shown, is inserted through a tool insert passage 2*k*, to move adjuster 54 back and forth, parallel to the arrow labeled L. Moving adjuster 54 back and forth adjusts the tension in spring 52. Adjusting the tension in spring 52 adjusts the pressure needed in passage 2*a* to unseat stem 51 from cap 21. When stem 51 is pushed against the cap 21, seals, not shown, between stem 51, and cap 21 prevent air from flowing to a pilot passage 2*b*. Passage 2*b* leads to a cushion exhaust valve 3, and a check valve 4.

Figure 8:
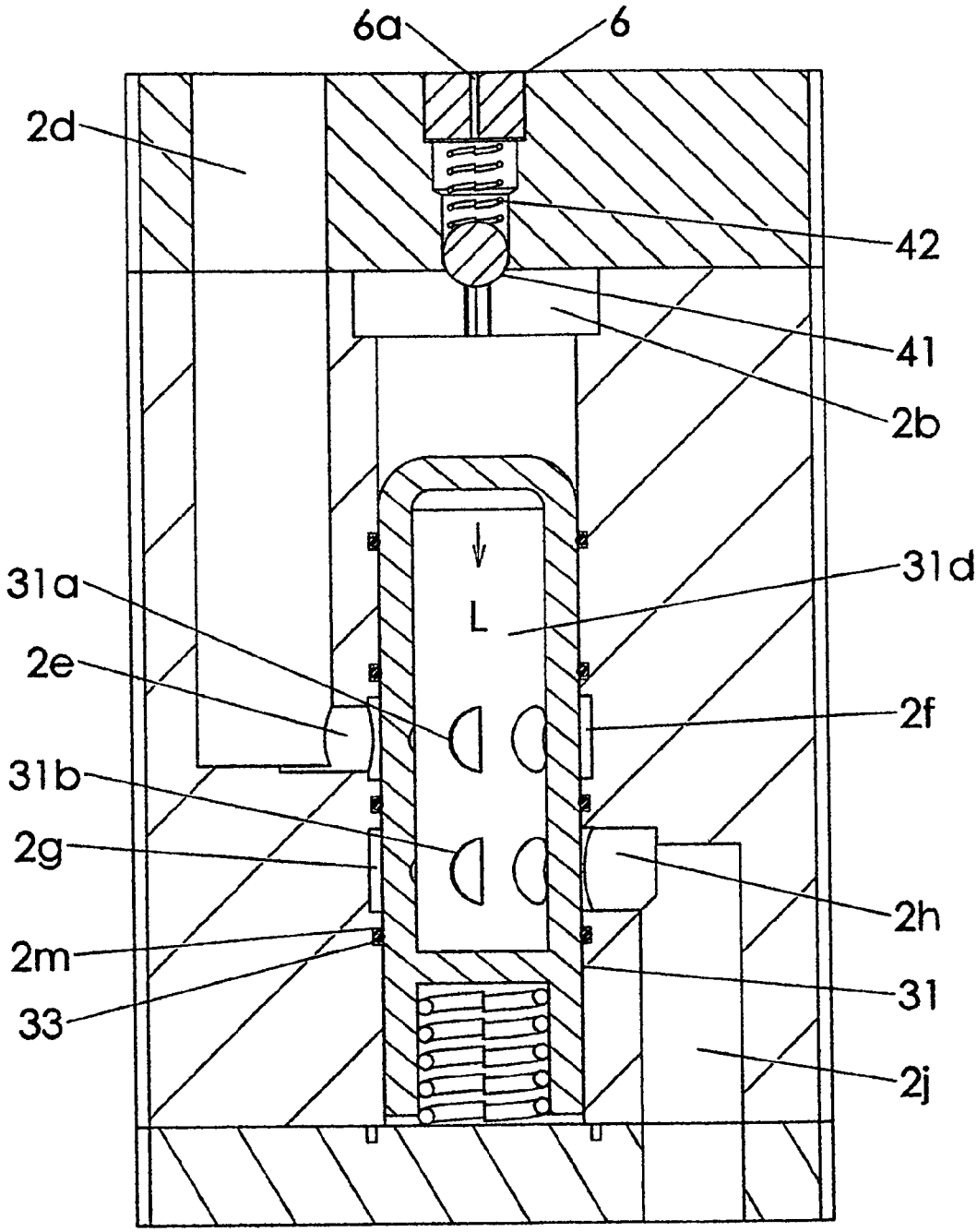
FIG. 8 is a cross-sectional view of the cushioning cartridge showing the main exhaust passages.

Valve 3 consists of several parts. Referring to FIG. 7 and FIG. 8, the core of valve 3 is a spool 31. Spool 31 is a hollow cylinder that is open at one end 31*f* and closed at the other end 31*g*. Two sets of holes, 31*a* and 31*b*, pass through the outer wall 31*e* of spool 31. Both sets of holes 31*a* and 31*b* consist of a pattern of holes that are located radially about spool 31. A spool spring 32 extends into the open end 31*f* of spool 31. One end of spring 32 presses against an inside partition 31*c* of spool 31. The other end of spring 32 presses against the inside surface of the cap 23. Four o-rings 33 are set into grooves 2*m* in housing 22. When spring 32 is fully extended, it pushes spool 31 into a spool stop, which is not shown, that keeps spool 31 from fully moving into passage 2*b*.

In this embodiment, valve 4 is directly across passage 2*b* from spool 31. Valve 4 fits inside passage 2*c* of cap 21. Valve 4 consists of two parts: a check ball 41, and a check valve spring 42. Ball 41 is prevented from fully entering passage 2*b* by a stop that is not shown. Spring 42 holds ball 41 in place. The other end of spring 42 butts against a restricting orifice plug 6. The restricting orifice plug 6 has a hole 6*a* with a predetermined sized hole drilled in it. Hole 6*a* is sized so as to allow fluid in passage 2*b* to very slowly bleed into its associated pressure chamber 1*a*, or 1*b*.

Passage 2*d* runs completely through cap 21, and approximately halfway through housing 22. Passage 2*e* connects passage 2*d* with a cavity 2*f* that rings spool 31. When spool 31 is seated in its stop, the location of cavity 2*f* aligns with hole set 31*b*.

Cap 23 has two passages. Passage 2*k* is coaxial with passage 2*a*. A second passage, a main exhaust port 2*j*, is located opposite of the center-line of housing 22 from passage 2*d*. Port C is the outer end of passage 2*j*. Passage 2*j* runs completely through cap 23, and part way into housing 22. Passage 2*h* radially connects passage 2*j* to a second cavity 2*g* that rings spool 31.

The logic schematic for cartridge 2 is shown in FIG. 1, inside the dashed lined box. Passage 2*a* connects inactive region 1*m* to valve 5. The output of valve 5 travels through passage 2*b* to a pilot port in valve 3. Passage 2*b* also feeds valve 4. Opposite valve 4 is plug 6. The output of plug 6 returns to passage 2*a*. Passage 2*d* connects region 1*m* to a port in valve 3. The output of valve 3 connects to port C. Similarly, cartridge 2' interfaces with region 1*n*.

Operation

Referring back to FIG. 1, and FIG. 2, to extend rod 1*c*, compressed air is supplied to port A. Air flows through passages 1*e*, and 1*j*, and into chamber 1*a*. Simultaneously, air exhausts from the downstream chamber 1*b* through passages 1*d*, 1*k*, and out port B. As pressure increases in chamber 1*a*, and decreases in chamber 1*b*, piston 1*p* moves to the left. As piston 1*p* nears its end of stroke, boss if enters into passage 1*d*. O-rings, not shown, in passage 1*d* engage boss 1*f*. This engagement prevents additional air from leaving chamber 1*b* through passage 1*d*. As piston 1*p* continues to move to the left, the pressure inside chamber 1*b* increases, as the air remaining in chamber 1*b* absorbs the inertial energy of piston 1*p*. At some point in time, the kinetic energy, and the velocity of piston 1*p* will be zero. At this point, the pressure in chamber 1*b* is at its maximum value. Since the air pressure in chamber 1*b* now exceeds the pressure in chamber 1*a*, piston 1*p* begins to move in the opposite direction, or bounce back. As piston 1*p* bounces back, the volume of chamber 1*b* increases, and the pressure in chamber 1*b* decreases. In the ideal situation, setting the tension in spring 52 to open at the maximum pressure, would cause the pressure in chamber 1*b* to immediately dissipate. Piston 1*p* would be stopped, and would have no pressure to make piston 1*p* reverse direction. However, to account for delays in exhausting the air, the tension in spring 52 is set to a pressure 'just before' the maximum pressure is reached. In practice, the tension in spring 52 is empirically determined.

Referring again to FIG. 7, and FIG. 8, once the pressure in chamber 1*b* reaches its predetermined value, stem 51 is pushed away from cap 21. Valve 5 opens. When valve 5 opens, air flows into passage 2*b*. Spool 31 moves, opening valve 3. Prior to spool 31 moving, pressurized air from chamber 1*b* flows through passages 2*d*, 2*e* and cavity 2*f* into spool chamber 31*d*. When spool 31 moves, spool hole set 31*b* moves away from cavity 2*f* and aligns with cavity 2*g*. Spool 31 hole set 31*a* now aligns with cavity 2*f*. Pressurized air from chamber 1*b* now exits through chamber 31*d*, cavity 2*g*, passages 2*h*, 2*j* and out port C. As pressure in chamber 1*b* decreases, air pressure in passage 2*b* overpowers spring 42, unseating ball 41. Valve 4 opens. Air in passage 2*b* now exits through valve 4 to chamber 1*b*. Passage 6*a* is sized in order to delay the loss of pressure from passage 2*b*. The delay in depleting air from passage 2*b* keeps spool 31 open longer. More air can escape from chamber 1*b*.

To retract piston 1*p*, air is redirected to port B. Chamber 1*a* becomes the downstream chamber, and cartridge 2' cushions piston 1*p*, as piston 1*p* reaches its retracted end of stroke.

Important Notes.

A few additional comments regarding the operation must be mentioned.

a. The volume of regions 1*m*, and 1*n*, affects the stopping ability of cartridges 2 and 2'. Changing the volume changes the rate at which the pressures in chamber 1*b* increases. For example, a larger volume will build deceleration pressures more slowly. Piston 1*p* can move farther, before it reaches its bounce-back position. The ideal volume will place the position of bounce back at the end of stroke. To achieve this ideal position, the volume of the inactive regions can be machined to a predetermined value, depending on the expected load, speeds, and air supply pressures that will be used. However, precisely machining the inactive region does not allow for flexibility in changing the volume of regions 1*m* and 1*n*, to account for changes in the expected loads, speeds, and air supply pressures. As an alternative, pockets 1*q*, 1*r*, 1*s*, and 1*t* can be machined into caps 1*z*, and 1*w*. Arc-segment shaped spacers 8, of varying thicknesses are secured into pockets 1*q*, 1*r*, 1*s*, and 1*t* with bolts 7. Varying the number and thicknesses of spacers 8, changes the volume of regions 1*m*, and 1*n*. This gives the ability to adjust the location of the bounce back point for piston 1*p*.

b. The air pressure needed to decelerate piston 1*p* will be several times greater than the pressure needed to accelerate piston 1*p*. Therefore valve 5 will not open during acceleration.

c. The length of boss 1*f*, affects when the pressure in 1*b* begins to increase. A longer boss 1*f*, will begin to cushion piston 1*p* sooner.

Embodiments

Figure 10:
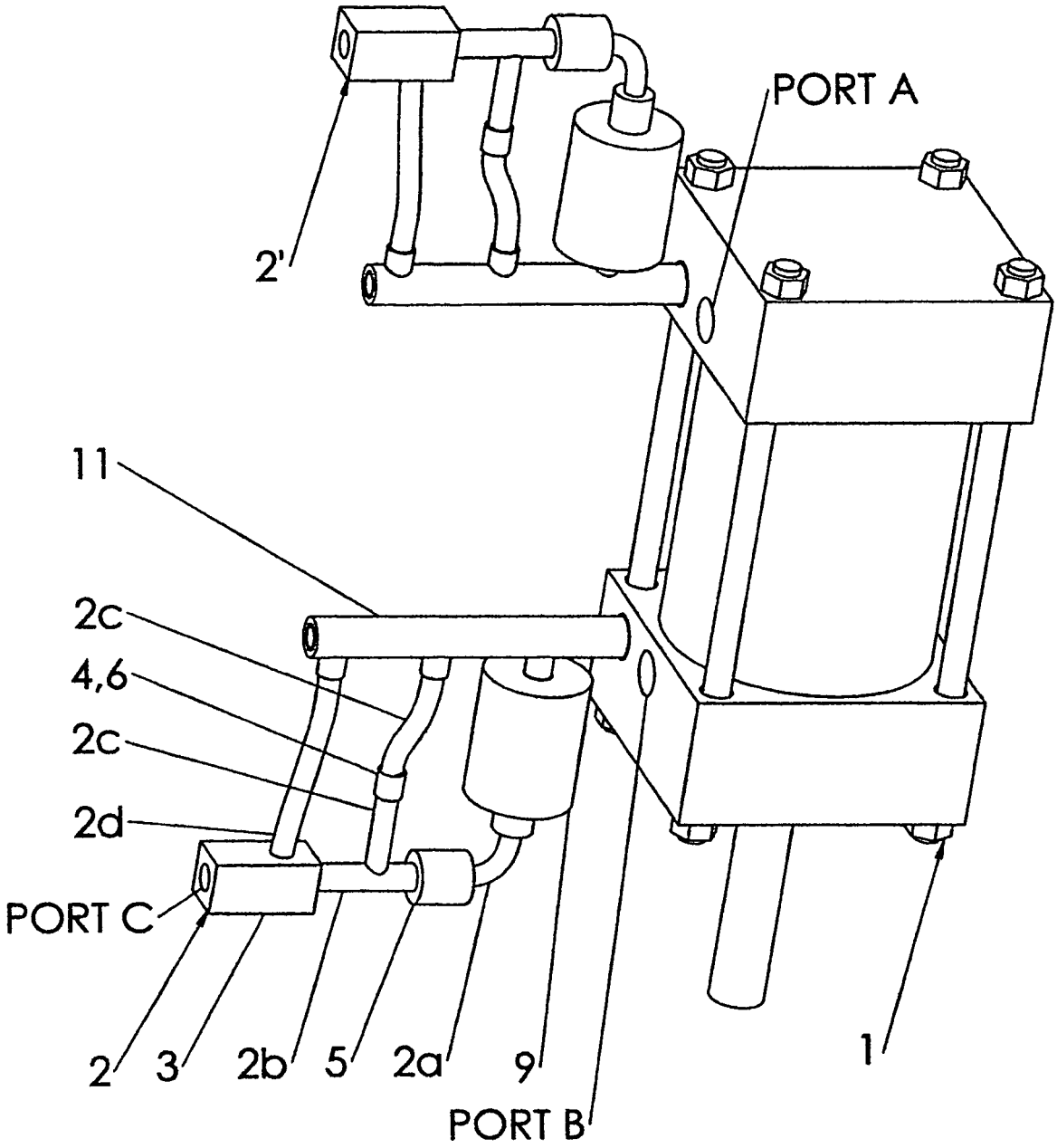
FIG. 10 is a 3D view of the cylinder with one embodiment of a cushion with components external to the cylinder.

The described embodiment is for an easily replaceable cushioning cartridge 2. However, the above mentioned detailed description is just one embodiment. The central idea for cushioning piston 1*p* is the method diagramed in the logic schematic found in FIG. 1. The main components, valve 3, valve 4, valve 5, and restricting orifice plug 6 can just as easily be installed as separate items inside, or outside of, cylinder 1. FIG. 10 gives one possible embodiment of an external component arrangement. In addition to the already discussed components, the air supply enters the cylinder through either port A or port B. After activating the cushioning stage, the exhaust air is routed through an exit manifold 11 to either cartridge 2 or 2'.

Additional embodiments can take the form of replacing some of the components described with off-the-shelf or custom designed sub-assemblies. For example, items 61, 41, & 42 can be made into a single check valve. Items 51, 52, 53, and 54 can be made as a single relief valve. Additionally, valve 5 can be replaced with an air-piloted relief valve to give a tighter break-free range. Valve 3 can be replaced with a suitably designed poppet, or other type of valve. Orifice 6*a*, can be placed upstream of the check valve 4. Furthermore, orifice 6*a* can be replaced with a variable orifice, needle valve.

Another embodiment uses an external accumulator 9 to replace spacers 8 in order to adjust the effective inactive region. Either an appropriately sized accumulator may be used, or an accumulator with an adjustable internal volume may be used.

Finally cartridge 2 is not limited to a pneumatic cylinder. Cartridge 2 can also be used to depressurize a hydraulic or pneumatic fluid chamber. The relative amount of unloading can be adjusted by changing the spring constant of spring 32. A lower spring constant will give a higher percentage of unloading.

I claim:

1. A method for cushioning the deceleration of a piston in an expandable chamber motor powered by a pneumatic fluid which comprises:

a) sensing a predetermined value in pressure of said pneumatic fluid on the downstream side of said piston in said expandable chamber motor, where said value indicates that said piston will reverse direction, and b) using said predetermined value in pressure to pilot a main exhaust passage for allowing said pneumatic fluid to rapidly and substantially depressurize at, or just before, a bounce-back position, where said piston reverses direction, and c) keeping sufficient pressure to pilot said main exhaust passage, until said pneumatic fluid on the downstream side has substantially depressurized, whereby said piston of said expandable chamber motor is brought to a full stop with minimized deceleration forces, and minimized bounce back.

2. The method of claim 1 further including:

a. allowing said pneumatic fluid on said downstream side of said piston to initially escape through a preliminary exhaust passage, and b. closing said preliminary exhaust passage for said pneumatic fluid after said piston reaches a predetermined position along the stroke of said piston, whereby said piston urges a rise in said pressure in remaining said pneumatic fluid.

3. The method of claim 2 further including changing an inactive volume of said downstream side whereby relocating said bounce-back position to the end of said stroke of said piston.

4. The method of claim 3 further including changing said predetermined stroke position, which blocks said pneumatic fluid from being further exhausted, whereby changing the start of the deceleration zone.

5. A means for unloading a pressurized fluid chamber comprising:

a. a pressure relief valve that opens at a predetermined pressure value, and b. the output of said pressure relief valve pressurizes a pilot port of a second valve that exhausts said fluid chamber, and c. a check valve and orifice that retains said output of said pressure relief valve in said pilot port of said second valve, until pressure in said pressurized fluid chamber reaches a lower, predetermined closing value, whereby said chamber is unloaded from said predetermined value.

6. The article of claim 5 further including said predetermined closing value substantially approaches the pressure of an exhaust reservoir.

7. The article of claim 5 further including said means can be made as a replaceable cartridge.

8. The article of claim 5, wherein said second valve is a spring return valve.

9. The article of claim 5 further including:

a. said pressurized fluid chamber, is the downstream side of a piston in an expandable chamber motor powered by a pneumatic fluid, and b. said predetermined value is a value that indicates that said piston will reverse direction.

10. The article of claim 9 further including:

a) a preliminary exhaust passage to allow a portion of said pneumatic fluid in said pressurized fluid chamber to escape from said pressurized fluid chamber, and b) a means to close said preliminary exhaust passage after said piston has reached a predetermined position of said piston's stroke, whereby said piston urges a rise in said pressure in remaining said pneumatic fluid.

11. The article of claim 10, further including a means to adjust an inactive volume of said downstream chamber, relocating the position where said piston will reverse direction to the end of stroke of said piston.

* * * * *